United States Patent [19]

Geng

[11] Patent Number: 4,794,821

[45] Date of Patent: Jan. 3, 1989

[54] METHOD OF ROLL FORMING A SKIP THREADING TAP

[75] Inventor: Jiang Y. Geng, Shanghai, China

[73] Assignee: Shanghai Bicycle Factory, Shanghai, China

[21] Appl. No.: 76,103

[22] Filed: Jul. 21, 1987

[30] Foreign Application Priority Data

Jul. 21, 1986 [CN] China ..... 86 101528

[51] Int. Cl.[4] ..... B21K 1/56

[52] U.S. Cl. ..... 76/101 B; 72/104

[58] Field of Search ..... 76/101 R, 101 B; 72/103, 104

[56] References Cited

U.S. PATENT DOCUMENTS 2,656,740 10/1953 Bedker ..... 76/101 B 2,873,634 2/1959 Moeltzner ..... 72/20

*Primary Examiner*—Roscoe V. Parker

*Attorney, Agent, or Firm*—Pennie & Edmonds

[57] ABSTRACT

A method of roll forming a skip threading tap by plastic deformation of metal.

8 Claims, 1 Drawing Sheet

METHOD OF ROLL FORMING A SKIP THREADING TAP

DESCRIPTION

TECHNICAL FIELD

The invention relates to the fabrication of a skip threading tap by a roll forming method and apparatus.

BACKGROUND OF THE INVENTION

Taps used for cutting or machining an internal thread in a workpiece are well known in the prior art. These taps which generally may be classified as a regular tap and a skip threading tap are distinguished one from the other by their thread pitch (S). To this end, the thread pitch of a skip threading tap is twice that of the thread pitch of a regular tap under circumstances that the pitch diameter pd and elevation angle ($\beta$) of the two threads are the same. As the thread pitch of the internal thread of the workpiece to be machined is determined by the elevation angle of the thread of the tap, the thread pitch of the internal thread machined either by a skip threading tap or regular tap will be the same if the elevation angle of both taps are the same.

A skip threading tap may be preferred in use since the thread pitch of the skip threading tap, being twice that of the thread pitch of the regular tap, is capable of machining an internal thread in a workpiece with an efficiency two to three times that of the efficiency achieved using a regular tap, and with a service life of two to three times as well. This in all likelihood is because the occurrence of clogging with filings is reduced; and since the grip between workpiece and skip threading tap is reduced it is also possible to avoid any mashing and cracking of threading of a skip threading tap. The reduction in grip is a result of less friction.

According to the prior art three methods of forming a skip threading tap are known. A first of the methods is characterized as a grinding method done by hand during which every other or alternate thread of a regular tap is ground away. Another method concerns the automatic removal of threads by operation of a relieving machine. Similarly, every other or alternate thread of a regular tap is ground away. A third method concerns the direct formation of a skip threading tap by operation of a thread grinder. According to this method, a quenched tap block is placed directly on a thread grinder having auxiliary equipment to grind both thread and skip thread simultaneously. This last method may be preferred over the first two methods from the standpoint of better quality of product. The method, however, requires a much longer period of effort which oftentimes cannot meet development requirements of production.

SUMMARY OF THE INVENTION

The present invention concerns the fabrication of a skip threading tap according to a method of roll forming, a method considered to significantly improve upon the prior art methods discussed above. The method utilizes the capability of plastic deformation of metal in the form of a tap block operated upon by a pair of roll tapping wheels composed of a surface of skip threading. According to the method, a skip threading screw is first formed by roll forming. The skip threading screw comprises an intermediate product transformed to a skip threading tap by a slotting and grooving operation. The method of the invention greatly increases the efficiency of fabrication of skip threading taps capable of excellent machining capability.

The method more particularly, comprises the steps of locating a pair of skip threading roll tapping wheels on individual shafts of a roll tapping machine and calibrating the spacing or gap therebetween. After calibration, a prefabricated tap block is located in the gap between the tapping wheels. In operation of the roll tapping machine the tapping wheels are caused to rotate in the same direction toward the tap block whose position is controlled by a movable wheel feed to, in essence, extrude the resulting tap block continuously resulting in plastic deformation to the form of a skip threading screw as the tapping wheels rotate. As indicated, the skip threading screw is both slotted and grooved thereby to form the skip threading tap.

Other features of the invention will become apparent as the description to be read in conjunction with a consideration of the drawing continues.

BEST MODE FOR CARRYING OUT THE INVENTION

Figure 1A:
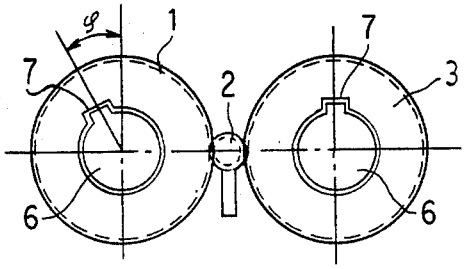
FIG. 1A illustrates in elevation a pair of tapping wheels and a tap block.
Figure 1B:
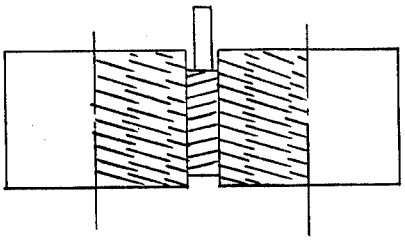
FIG. 1B is a view of the tapping wheels and tap block of FIG. 1A rotated through an angle of 90°.
Figure 2B:
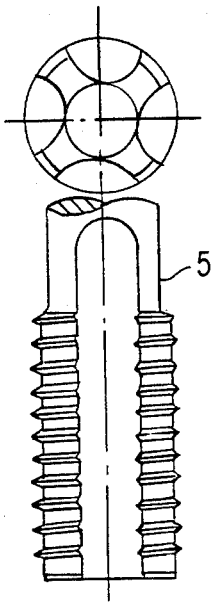
FIG. 2B illustrates a skip threading tap.

Referring to Figs. IA and 1B, there is illustrated a pair of skip threading roll tapping wheels (tapping wheels) 1, 3 and a tap block 2 to be fabricated into a skip threading tap by roll forming, slotting and grooving. The tapping wheels are each formed of a hard metallic material, such as chromium ($Cr_{12}$), heat treated according to HRC 60-63. Each tapping wheel is formed with skip threading throughout the outer surface thereby utilizing the capability of plastic deformation of metal to transform the tap block to a skip threading screw 4 (see FIG. 2A) as the tapping wheels rotate in the same direction of rotation about their axes. The mounting structure of each tapping wheel is shown generally in FIG. IB and includes a shaft 6 of a roll tapping machine. A keyway 7 between the shaft and tapping wheel locates the tapping wheel for conjoint movement. As illustrated in FIG. 2B, the skip threading tap 5, the final product of the method, is formed by slotting and grooving the skip threading screw 4 or intermediate product.

This method of roll forming a skip threading tap improves upon the methods of the prior art in efficiency of fabrication and in the form of product fabricated.

Shafts 6 are located in a parallel, spaced relation and each tapping wheel has an outside diameter (D) equal to the pitch diameter pd of the skip threading tap to be machined multiplied by the number of threads (N) arranged in a group on the circumference of the tapping wheel. According to the invention N is an even number. Each tapping wheel, further, has a thread elevation ($\beta$) and a thread pitch (2S) equal to the elevation and pitch of the thread to be machined. The deflecting angle ($\phi$) of the tapping wheel opposite each other at the thread joint is determined by the equation $$\phi = 360°/2N$$

and the length of each tapping wheel is a round number multiple of the thread pitch (2S) of the skip threading tap to be machined.

Tap block 2 from which the skip threading tap is formed is comprised of a high speed steel material, such as $W_{18r4v}$ which is quenched by sealed quenching to a hardness of HRC 12. The tap block is cut and machined, both left and right, to the size of the skip threading tap with an error of no more than about 0.01 mm.

The apparatus must be adjusted before operation of the tapping wheels. To this end, the shaft keys of the roll tapping machine are adjusted i the same direction toward the tap block so that the central line of the shaft keys balance each other. The tapping wheels are located by the shaft keys in position that the end surfaces of the tapping rolls locate along a straight line. And, the relative distance or gap between the two tapping wheels will be adjusted to equal the outside diameter of the tap block less the distance 3H/2 wherein H is the depth of teeth of the tap. Once it is determined that the clearance, finish and angle of teeth of the test rolled threads meet the required specifications, and following flushing of the test roll with a cooling fluid during a test run, the tapping wheels may be put to normal operation.

Figure 2A:
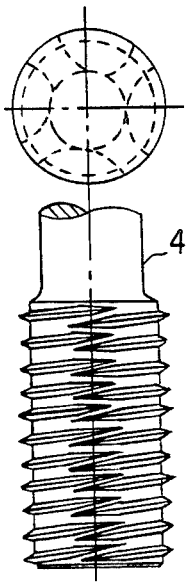
FIG. 2A illustrates the intermediate product of a skip threading screw.

The skip threading screw 4 formed by the cold rolling operation of tapping wheels 1, 3 is shown in FIG. 2A and skip threading tap 5 formed by slotting and grooving the skip threading screw is shown in FIG. 2B. The geometric shape of the skip threading tap formed by cold roll forming, slotting and grooving, as well as the technical precision, finish of thread, neighboring thread pitch and accumulated thread pitch of the skip threading tap have been measured by a tool microscope with the finding that it falls within precision requirements. Table 1 presents comparison data taken from measurements before and after heat treatment of a skip threading tap of cold rolled left 2 M 18×1.

TABLE 1

| Before/ after heat treatment | Item: Teeth angle of thread: Left half angle | Teeth angle of thread: Right half angle | Neighboring thread pitch mm | 10 S accumulated thread pitch error | Finish |
|---|---|---|---|---|---|
| Before heat treatment | 29° 46′ | 30° 2′ | ±0.004 | ±0.004 | ∇ 9 |
| After heat treatment | 29° 52′ | 30° 9′ | ±0.004 | ±0.01 | ∇ 8–9 |

It has been found in comparing a cold rolled skip threading tap of the invention and a ground skip threading tap that their internal metallurgical structure, martemper, carbide and residual austenite are substantially the same. The finish of the internal threads is also substantially the same and both of the taps reach a finish of ∇6—∇7. The structure of the cold rolled skip threading tap is compact and its fiber shows continuity to enhance strength of threads. The fiber structure of the ground skip threading tap, however, was found to be in broken shape. In addition to these comparisons, it has been found that the cold rolled skip threading tap is capable of being subjected to greatly enhanced machine efficiency. To this end, the machining of two skip threading taps of left 22 M 18×1 and M 14×1.25 by a thread grinder takes about thirty minutes per tap. On the other hand each tap fabricated by the cold roll forming method of the invention requires only about five seconds' time. This increase of efficiency, a factor of about one hundred eighty times, translates into significant production cost savings.

I claim:

1. A method for roll forming a skip threading tap, comprising the steps of:

mounting a pair of tapping wheels having thread forming elements formed thereon for rotation about parallel axes spaced such that a gap is provided between confronting surfaces of said tapping wheels;

disposing a tap block in said gap;

rotating said tapping wheels in the same direction toward said tap block, and feeding said tap block along the gap, extruding the tap block, so that threads are formed on said block resulting from its plastic deformation, and slotting and grooving said skip threading tap;

wherein the thread elevation angle ($\beta$) and thread pitch (2S) of said thread forming elements formed on said tapping wheels equal the thread elevation angle and thread pitch of the thread formed on the tap.

2. The method of claim 1 wherein the outside diameter of said tapping wheels equals the pitch diameter (pd) of the skip threading tap to be formed times the number N, N being an even number, of the groups of thread forming elements spaced circumferentially around the tapping wheels.

3. The method of claim 2 wherein the rotational position of the tapping wheels with respect to one another is fixed, and the relative position of the threading element on one tapping wheel is rotated with respect to those on the other through an angle ($\phi$) equal to 360°/2N.

4. The method of claim 1, wherein the length of the tapping wheels is an integer multiple of the thread pitch 2S.

5. Apparatus for the formation of a skip threading tap comprising:

a pair of tapping wheels having thread forming elements formed thereon for rotation about parallel axes spaced such that a gap is provided between confronting surfaces of said tapping wheels;

means for rotating said tapping wheel in the same direction toward a tap block, and feeding said tap block along the gap, extruding the tap block, so that threads are formed on said block resulting from its plastic deformation;

slotting and grooving said skip threading tap; and wherein the means for forming the thread elevation angle ($\beta$) and thread pitch (2S) of said thread forming elements formed on said tapping wheels equal the thread elevation angle and thread pitch of the thread formed on the tap.

6. The apparatus of claim 5 wherein the outside diameter of said tapping wheels equal the pitch diameter (pd) of the skip threading tap to be formed times the number N, an being even number, of the groups of thread forming elements spaced circumferentially around the tapping wheels.

7. The apparatus of claim 6 wherein the rotational position of the tapping wheels with respect to one another is fixed, and the relative position of the threading elements on one tapping wheel are rotated with respect to those one the other through an angle ($\phi$) equal to 360°/2N.

8. The apparatus of claim 7, wherein the length of the tapping wheels is an integer multiple of the thread pitch 2S.

* * * * *